US006729901B2

(12) United States Patent
Aekins

(10) Patent No.: US 6,729,901 B2
(45) Date of Patent: May 4, 2004

(54) WIRE GUIDE SLED HARDWARE FOR COMMUNICATION PLUG

(75) Inventor: Robert A. Aekins, Branford, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 09/968,103

(22) Filed: Oct. 1, 2001

(65) Prior Publication Data

US 2002/0142644 A1 Oct. 3, 2002

Related U.S. Application Data

(60) Provisional application No. 60/237,758, filed on Sep. 29, 2000, and provisional application No. 60/282,308, filed on Apr. 5, 2001.

(51) Int. Cl.[7] ..... H01R 4/24
(52) U.S. Cl. ..... 439/418
(58) Field of Search ..... 439/395, 941, 439/676, 418

(56) References Cited

U.S. PATENT DOCUMENTS

| | | | |
|---|---|---|---|
| 2,714,194 | A | 7/1955 | Beynink |
| 5,269,708 | A | 12/1993 | DeYoung et al. |
| 5,310,363 | A | 5/1994 | Brownell et al. |
| 5,326,284 | A | 7/1994 | Bohbot et al. |
| 5,341,419 | A | 8/1994 | Ferry |
| 5,362,257 | A | 11/1994 | Neal et al. |
| 5,399,107 | A | 3/1995 | Gentry et al. |
| 5,414,393 | A | 5/1995 | Rose et al. |
| 5,432,484 | A | 7/1995 | Klas et al. |
| 5,299,956 | A | 10/1995 | Brownell et al. |
| 5,513,065 | A | 4/1996 | Caveney et al. |
| 5,547,405 | A | 8/1996 | Pinney et al. |
| 5,586,914 | A | 12/1996 | Foster, Jr., et al. |
| 5,599,209 | A | 2/1997 | Belopolsky |
| 5,618,185 | A | 4/1997 | Aekins |
| 5,639,266 | A | 6/1997 | Patel |
| 5,647,770 | A | 7/1997 | Belopolsky |
| 5,674,093 | A | 10/1997 | Vaden |
| 5,687,478 | A | 11/1997 | Belopolsky |
| 5,697,817 | A | 12/1997 | Bouchan et al. |
| 5,759,070 | A | 6/1998 | Belopolsky |
| 5,779,503 | A | 7/1998 | Tremblay et al. |
| 5,864,089 | A | 1/1999 | Rainal |
| 5,911,602 | A | 6/1999 | Vaden |
| 5,913,702 | A | 6/1999 | Garcin |
| 5,931,703 | A | 8/1999 | Aekins |
| 5,938,479 | A | 8/1999 | Paulson et al. |
| 6,023,200 | A | 2/2000 | Rhee |
| 6,089,923 | A | 7/2000 | Phommachanh |
| 6,120,329 | A | 9/2000 | Steinman |
| 6,155,881 | A | 12/2000 | Arnett et al. |
| 6,193,542 | B1 | 2/2001 | Marowsky et al. |
| 6,231,397 | B1 | 5/2001 | de la Borbolla et al. |
| 6,358,091 | B1 | 3/2002 | Lo et al. |
| 6,358,092 | B1 | 3/2002 | Siemon et al. |

FOREIGN PATENT DOCUMENTS

| | | |
|---|---|---|
| WO | WO 99/17406 | 4/1999 |
| WO | WO 01/08268 A1 | 2/2001 |

OTHER PUBLICATIONS

European Search Report dated Jul. 17, 2002.

*Primary Examiner*—Neil Abrams
*Assistant Examiner*—Phuong Dinh
(74) *Attorney, Agent, or Firm*—McCarter & English LLP

(57) ABSTRACT

The present disclosure provides a front-end plug sled device for controlling de-embedded NEXT and FEXT variations that are produced during patch cordage assembly. Such sled device advantageously reduces variations by receiving a data transfer media cable having data elements therein, protecting against distortion of the elements which usually occurs during installation with a media plug, and guiding the elements into proper alignment to be easily connected with a media plug.

48 Claims, 7 Drawing Sheets

Fig. 13
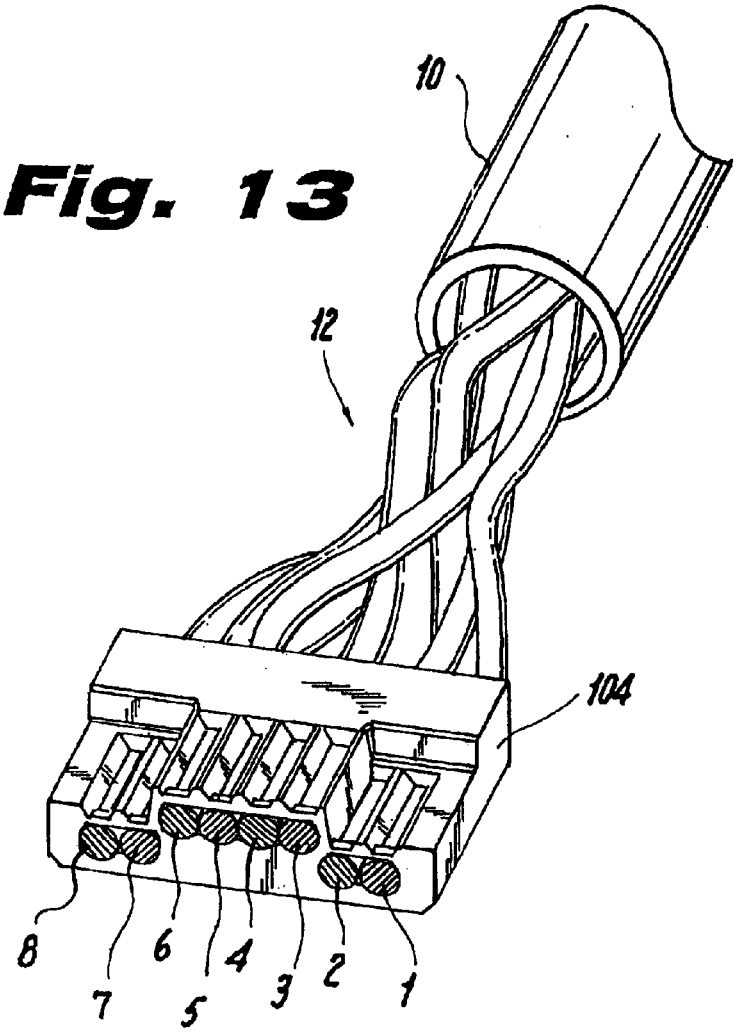
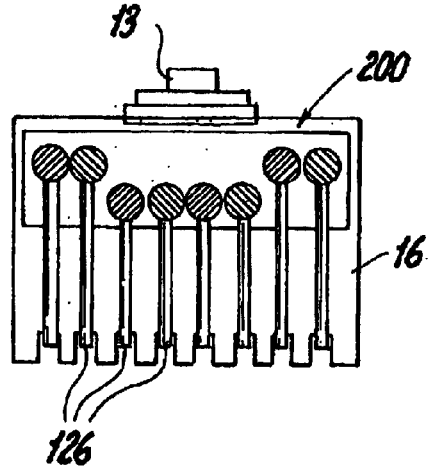
Fig. 14

WIRE GUIDE SLED HARDWARE FOR COMMUNICATION PLUG

CROSS-REFERENCE TO RELATED APPLICATION(S)

The subject application claims the benefit of commonly owned, co-pending U.S. Provisional Application Ser. No. 60/237,758, filed Sep. 29, 2000, and commonly owned, co-pending U.S. Provisional Application Ser. No. 60/282,308, filed Apr. 5, 2001, the disclosures of which are herein incorporated by reference.

BACKGROUND OF THE DISCLOSURE

1. Technical Field

The present disclosure relates to devices for interfacing with high frequency data transfer media and, more particularly, to wire guide sleds, such as those that are used for installing an altered height contact communication plug on an Unshielded Twisted Pair ("UTP") media, that advantageously compensate for and reduce electrical noise.

2. Background Art

In data transmission, the signal originally transmitted through the data transfer media is not necessarily the signal received. The received signal will consist of the original signal after being modified by various distortions and additional unwanted signals that affect the original signal between transmission and reception. These distortions and unwanted signals are commonly collectively referred to as "electrical noise," or simply "noise." Noise is a primary limiting factor in the performance of a communication system. Many problems may arise from the existence of noise in connection with data transmissions, such as data errors, system malfunctions and/or loss of the intended signals.

The transmission of data, by itself, generally causes unwanted noise. Such internally generated noise arises from electromagnetic energy that is induced by the electrical energy in the individual signal-carrying lines within the data transfer media and/or data transfer connecting devices, such electromagnetic energy radiating onto or toward adjacent lines in the same media or device. This cross coupling of electromagnetic energy (i.e., electromagnetic interference or EMI) from a "source" line to a "victim" line is generally referred to as "crosstalk."

Most data transfer media consist of multiple pairs of lines bundled together. Communication systems typically incorporate many such media and connectors for data transfer. Thus, there inherently exists an opportunity for significant crosstalk interference.

Crosstalk can be categorized in one of two forms. Near end crosstalk, commonly referred to as NEXT, arises from the effects of near field capacitive (electrostatic) and inductive (magnetic) coupling between source and victim electrical transmissions. NEXT increases the additive noise at the receiver and therefore degrades the signal to noise ratio (SNR). NEXT is generally the most significant form of crosstalk because the high-energy signal from an adjacent line can induce relatively significant crosstalk into the primary signal. The other form of crosstalk is far end crosstalk, or FEXT, which arises due to capacitive and inductive coupling between the source and victim electrical devices at the far end (or opposite end) of the transmission path. FEXT is typically less of an issue because the far end interfering signal is attenuated as it traverses the loop.

Unshielded Twisted Pair cable or UTP is a popular and widely used type of data transfer media. UTP is a very flexible, low cost media, and can be used for either voice or data communications. In fact, UTP is rapidly becoming the de facto standard for Local Area Networks ("LANs") and other in-building voice and data communications applications. The wide acceptance and use of UTP for data and voice transmission is primarily due to the large installed base, low cost and ease of new installation. Another important feature of UTP is that it can be used for varied applications, such as for Ethernet, Token Ring, FDDI, ATM, EIA-232, ISDN, analog telephone (POTS), and other types of communication. This flexibility allows the same type of cable/system components (such as data jacks, plugs, cross-patch panels, and patch cables) to be used for an entire building, unlike shielded twisted pair media ("STP").

There are typically four pairs of copper wires that are used, with each pair forming a twisted pair. The four pairs are used in horizontal cabling as well as for patch cabling or patch cordage. Patch cordage in terms of this disclosure is any unspecified length of UTP cable that is assembled by pressure crimping onto a RJ45 plug.

At present, UTP is being used for systems having increasingly higher data rates. Since demands on networks using UTP systems (e.g., 100 Mbit/s and 1200 Mbit/s transmission rates) have increased, it has become necessary to develop industry standards for higher system bandwidth performance. As the speeds have increased, so too has the noise. Systems and installations that began as simple analog telephone service and low speed network systems have now become high speed data systems. In particular, the data systems in the past used standard plug to cable assembly technique, which achieved reasonable Near-end Crosstalk (NEXT) and Far-end crosstalk (FEXT) noise levels and noise variability. The standard plug to cable assembly methods were used for the ANSI/TIA/EIA 568A "Commercial Building Telecommunications Cabling Standards" category 5 patch cords.

The ANSI/TIA/EIA 568A standard defines electrical performance for systems that utilize the 1 to 100 MHz frequency bandwidth range. Exemplary data systems that utilize the 1–100 MHz frequency bandwidth range include IEEE Token Ring, Ethernet10Base-T and 100Base-T. EIA/TIA-568 and the subsequent TSB-36 standards define five categories, as shown in the following Table, for quantifying the quality of the cable (for example, only Categories 3, 4, and 5 are considered "datagrade UTP").

TABLE

| Category | Characteristic specified up to (MHz) | Various Uses |
|---|---|---|
| 1 | None | Alarm systems and other non-critical applications |
| 2 | None | Voice, EIA-232, and other low speed data |
| 3 | 16 | 10BASE-T Ethernet, 4-Mbits/s Token Ring, 100BASE-T4, 100VG-AnyLAN, basic rate ISDN. Generally the minimum standard for new installations. |
| 4 | 20 | 16-Mbits/s Token Ring. Not widely used. |
| 5 | 100 | TP-PMD, SONet, OC-3 (ATM), 100BASE-TX. The most popular for new data installations. |

Underwriter's Laboratory defines a level-based system, which has minor differences relative to the EIA/TIA-568's category system. For example, UL requires the characteristics to be measured at various temperatures. However, generally (for example), UL Level V (Roman numerals are used) is the same as EIA's Category 5, and cables are usually marked with both EIA and UL rating designations.

Since the beginning of the ANSI/TIA/EIA 568A standard there has been no category 5 patch cord standard, but there has been a channel link standard. The channel link is a completely installed UTP cabling system that contains the patch cordage, connecting hardware and horizontal cables used for media connection of two or more network devices. The TIA/EIA is developing a patch cord standard as well as a plug level standard that will become requirements for development of category 5e (enhanced) and category 6 connecting hardwares.

Additionally, the EIA/TIA-568 standard specifies various electrical characteristics, including the maximum cross-talk (i.e., how much a signal in one pair interferes with the signal in another pair—through capacitive, inductive, and other types of coupling). Since this functional property is measured as how many decibels (dB) quieter the induced signal is than the original interfering signal, larger numbers reflect better performance.

Category 5 cabling systems generally provide adequate NEXT margins to allow for the high NEXT associated with use of present UTP system components. Demands for higher frequencies, more bandwidth and improved systems (e.g., Ethernet 1000Base-T) on UTP cabling, render existing systems and methods unacceptable. The TIA/EIA category 6 draft addendum related to new category 6 cabling standards illustrates heightened performance demands. For frequency bandwidths of 1 to 250 MHz, the draft addendum requires the minimum NEXT values at 100 MHz to be −39.9 dB and −33.1 dB at 250 MHz for a channel link, and −54 dB at 100 MHz and −46 dB at 250 MHz for connecting hardware. Increasing the bandwidth for new category 6 (i.e., from 1 to 100 MHz in category 5 to 1 to 250 MHz in category 6) increases the need to review opportunities for further reducing system noise.

By increasing the bandwidth from 1–100 MHz (cat 5) to 1–250 MHz (cat 6), tighter control of the components' noise variability is necessary. With the development of the new standards, the new plug noise variability will need to be better controlled than plugs that used old assembly methods.

Furthermore, the TIA/EIA Unshielded Twisted Pair Cabling task groups have developed a working draft for a UTP Connecting Hardware plug measurement parameter called NEXT de-embedding. The de-embedded NEXT procedure measures the pure NEXT and FEXT contributions of the plug and all other noise contributions are factored out of the final result. This method has become the de facto standard for RJ45 plug NEXT and FEXT characteristic measurement for plugs that are used to test connecting hardware performance. Plug de-embedded NEXT and FEXT variability was not an issue with category 5 connecting hardware or channel link systems, so upper and lower ranges were not specified. The TIA/EIA connecting hardware working groups have since realized that the plug de-embedded NEXT and FEXT must be controlled so the proper development of category 5e and category 6 connecting hardware/systems can become possible. The plug de-embedded NEXT and FEXT directly relates to the performance of the patch cordage and the connecting hardware that connects to it. Controlling the plug de-embedded NEXT and FEXT will enable control of the category 5, 5e and 6 NEXT performance. One method of category 5 connecting hardware crosstalk noise reduction and controlling is addressed in U.S. Pat. No. 5,618,185 to Aekins, the subject matter of which is hereby incorporated by reference.

The plug assembly crimping procedure heavily distorts the plug's de-embedded NEXT associated with patch cordage. This procedure is the final assembly method that forces the Insulation Displacement Contacts and the plug cable holding bar (also called strain relief) into their final resting positions. The plug cable holding bar is one of the main de-embedded NEXT disturbers since it distorts the wire pattern differently during the crimping stage. The other noise factor is at the plug front-end contacts area. The plug contacts are a major NEXT contributor because the wire pairs are typically aligned in a parallel co-planar array which increases the inductance/reactance resulting in increased the crosstalk noises.

In view of the increasing performance demands being placed on UTP systems, e.g., the implementation of category 6 standards, it would be beneficial to provide a device and/or methodology that is able to protect against wire distortion to reduce de-embedded NEXT and FEXT noises associated with patch cordage assembly.

SUMMARY OF THE DISCLOSURE

The present disclosure provides a front-end plug sled device for controlling de-embedded NEXT and FEXT variations that are produced during patch cordage assembly. Such sled device advantageously reduces variations by receiving a data transfer media cable having data elements therein, protecting against distortion of the elements which usually occurs during installation with a media plug, and guiding the elements into proper alignment to be easily connected with a media plug.

In one aspect of the present disclosure, a wire guide sled device that does not deform the wire pairs beyond standard twist configuration is disclosed.

In another aspect of the present disclosure, a wire guide sled for protecting data transmitting elements in a connection between data transmission media having a plurality of data transmitting elements and a media plug having a female receiving port and a connecting end are disclosed.

In yet another aspect of the present disclosure, a wire guide sled for aligning a plurality of negatively charged and positively charged data transmission elements to properly connect with a media plug is disclosed. The device has a support member body having a front portion and a rear portion defining at least two rows, each having a plurality of elongated channels for guiding each element of the plurality of elements into the proper position to connect with the media plug. The rows are parallel with respect to the longitudinal axis of the support member body. Preferably, the rows are also at different planes with respect to the latitudinal axis of the support member body. It is also preferred that the plurality of channels in each row are used to separate elements of negative and positive polarity from each other.

In yet another aspect of the present disclosure, a data transmission plug assembly for protecting against distortion of data transmitting elements is disclosed. The assembly includes a media plug having a female receiving port and a connecting end having a plurality of conduits for aligning the data elements to connect with other types of components. The assembly further includes a male wire guide having two rows of guides at different planes with respect to each other. Each row of guides engages a portion of the data transmitting elements and arranges the data transmitting elements to substantially conform with the alignment of the conduits in the connecting end of the media plug when the male wire guide is inserted into the female receiving port of the media plug. Preferably, the guides insulate the elements from each other and prevent crosstalk noises.

In yet another aspect of the present disclosure, a wire guide sled having a generally rectangular support member body for insertion in a communication plug receiving port is disclosed. An upper row of elongated channels and a lower row of elongated channels are defined on the upper surface of the body. The upper row is at an elevated plane with respect to the lower row and the channels extend parallel to the longitudinal axis of the support member body. Preferably, there are a total of eight adjacent channels in the upper and lower rows, corresponding with standard number of wires in a UTP cable. It is further preferred that the upper row have the first, third, sixth and eighth channels and the lower row have the second, fourth, fifth, and seventh channels, respectively.

Other features and benefits of the disclosed guide sled device and associated system/method will be apparent from the detailed description and accompanying figures which follow.

BRIEF DESCRIPTION OF THE DRAWINGS

So that those having ordinary skill in the art to which the subject disclosure appertains will more readily understand how to construct and employ the subject disclosure, reference may be had to the drawings wherein:

FIG. 13 is a perspective view of the wire guide sled in FIG. 8 with wires inserted and aligned according to a preferred embodiment of the present disclosure.

FIG. 14 is a front view of the wire guide sled in FIG. 8 inserted in a communication plug housing.

Figure 1A:
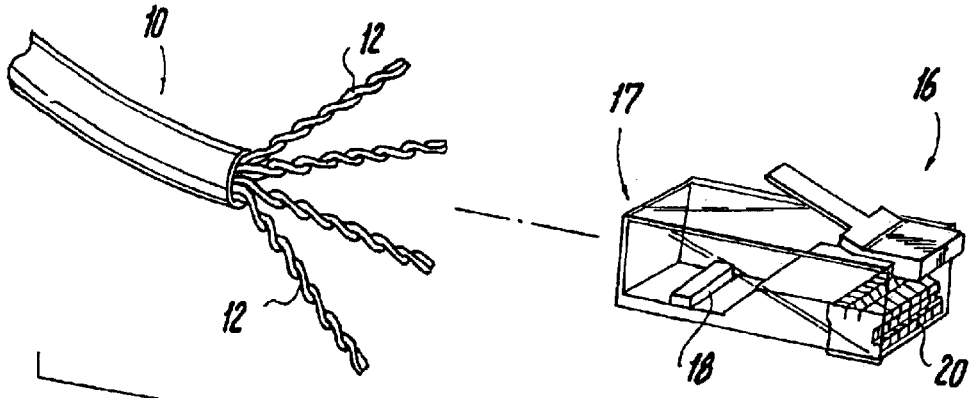
Fig. 1a (Prior Art)
FIGS. 1*a,* 1*b* and 1*c* provide a set of exploded perspective views illustrating the prior art assembly method of a RJ45 plug and UTP cable having four wire pairs.
Figure 1B:
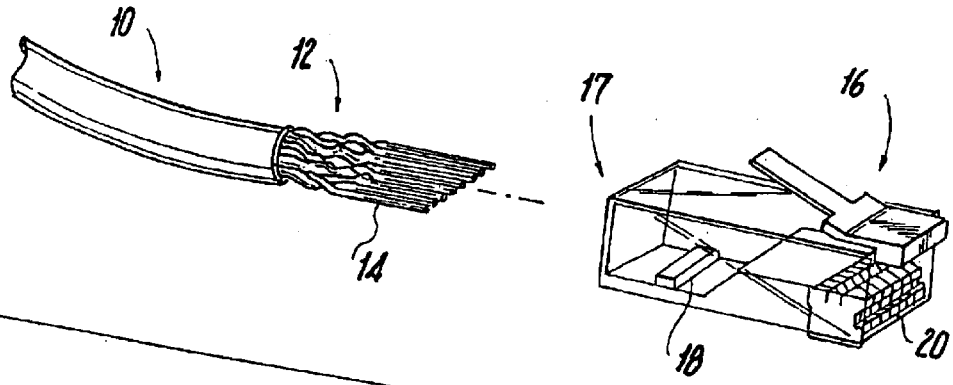
Fig. 1b (Prior Art)

These and other features of the exemplary stabilizer systems according to the subject disclosure will become more readily apparent to those having ordinary skill in the art from the following detailed description of preferred and exemplary embodiments.

DETAILED DESCRIPTION OF PREFERRED EMBODIMENT(S)

The following detailed description of preferred and/or exemplary embodiments of the present disclosure is intended to be read in the light of, or in context with, the preceding summary and background descriptions. Unless otherwise apparent, or stated, directional references, such as "up", "down", "left", "right", "front" and "rear", are intended to be relative to the orientation of a particular embodiment of the disclosure as shown in the first numbered view of that embodiment. Also, a given reference numeral should be understood to indicate the same or a similar structure when it appears in different figures.

Figure 1C:
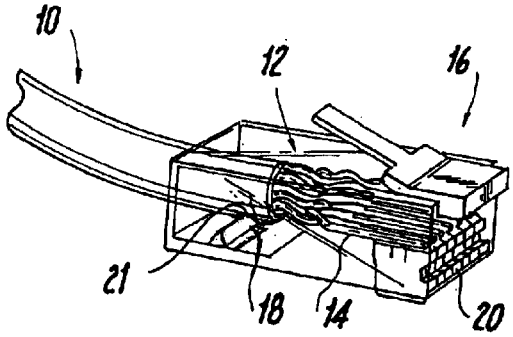
Fig. 1c (Prior Art)
Figure 2:
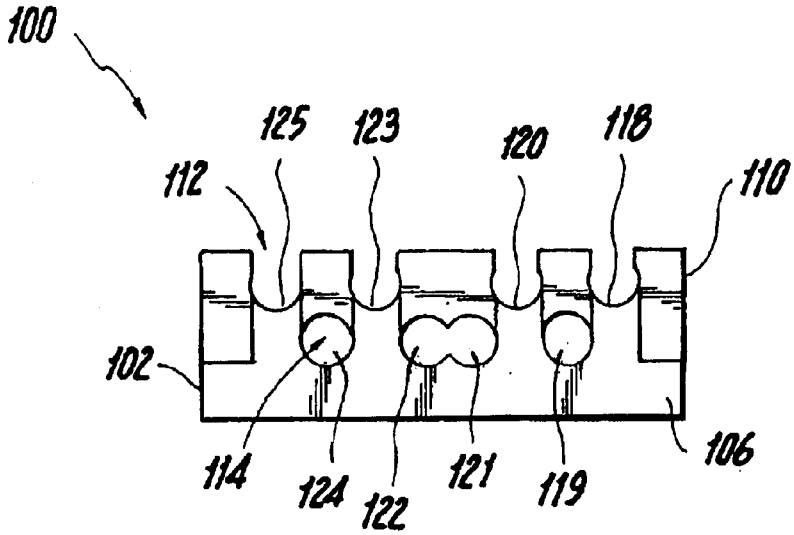
FIG. 2 is a front view of an exemplary wire guide sled fabricated in accordance with the present disclosure.
Figure 3:
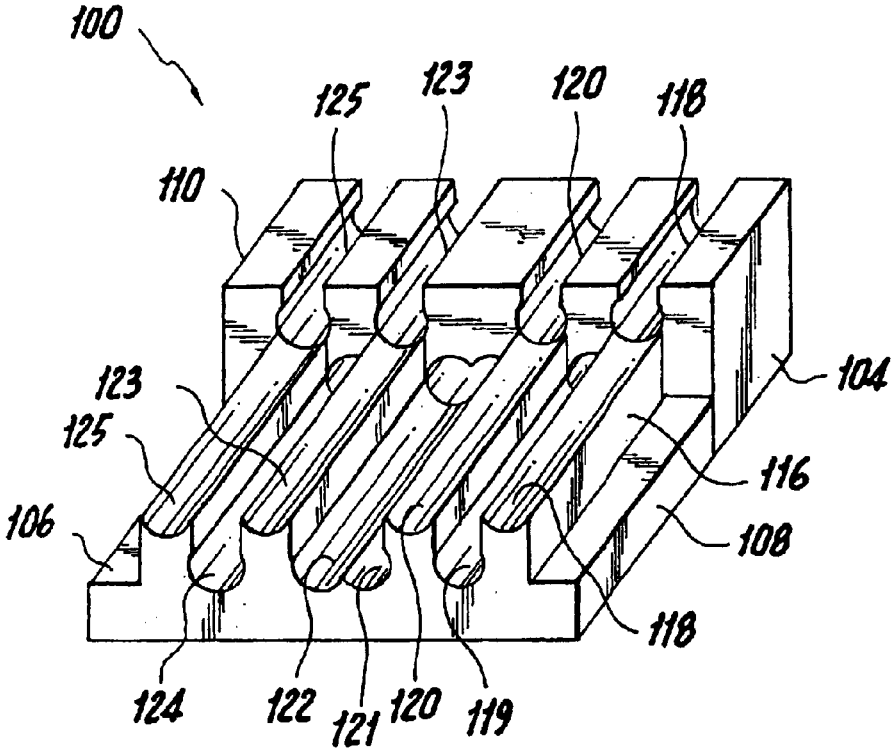
FIG. 3 is a perspective view of the exemplary wire guide sled in FIG. 2.

FIGS. 1*a,* 1*b* and 1*c* illustrate the order of assembly in a typical prior art UTP cable to RJ45 plug installation. A UTP cable 10 containing four twisted wire pairs 12 is made up of individual wire conductors 14. A typical RJ45 plug 16 has a cable receiving cavity 17 into which cable 10 is inserted and a strain relief or crimp bar 18. RJ45 plug housing 16 also has eight Insulation Displacement Contacts ("IDC") contacts 20 that penetrate and expose the insulation of wires 14 and make contact with the conductive elements of other components into which plug 16 is inserted. After insertion of the cable 10, crimping pressure is applied to the exterior of the plug 16, and crimp bar 18 applies substantial pressure to cable 10 which causes the deformation of cable 10 at point 21, as seen in FIG. 1*c*. The crimping pressure applied to the housing also causes contacts 20 to penetrate the insulation of the wires 14.

FIGS. 2 through 7 illustrate a preferred embodiment of the presently disclosed guide sled 100. Sled 100 comprises a generally rectangular support body 102 having a rear end portion 104, front end portion 106, and longer sides 108. Preferably, body 102 is fabricated of a synthetic resin, or any like material which is resilient or deformable, such as Acrylonitrile/Butadiene/Stryrene (ABS). A wire receiving block 110 is located adjacent rear end portion 104. An upper row 112 and lower row 114 of grooved guide channels extend along the longitudinal axis of body 102, from rear end 104 through receiving block 110 to front end 106. Upper row channels 112 are elevated above lower row channels 114 relative to body 102.

Upper row channels 112 extend generally in the same plane. In rear end portion 104, upper row channels 112 extending through receiving block 110 form partially enclosed conduits. In front end portion 106, upper row channels 112 extending along body 102 are elevated by channel support members 116 which protrude perpendicularly from body 102.

Similarly, lower row channels 114 also extend generally in the same plane. In rear end portion 104, lower row channels 114 extending through receiving block 110 form enclosed conduits. In front end portion 106, lower row channels 114 extending along body 102 are partially enclosed by adjacent channel support members 116.

Upper row 112 has guide channels 118, 120, 123 and 125 for guiding individual wires. Lower row 1114 has guide channels 119, 121, 122 and 124 for guiding individual wires. In this embodiment, the eight channels 118–125 match the size and shape of the eight wires in a standard UTP cable. It is to be understood that the number and dimensions of channels 118–125 may be altered, depending on the size and number of data transmitting elements in the data transmitting media, and still be within the purview of this disclosure.

During installation, the outer sheath of cable 10 is stripped to expose wires 12 which are laid along channels 118–125. Receiving block 110 holds wires 12 in position and front end portion 106 supports the wires for an IDC crimp connection.

Preferably, the wires in an four pair UTP are arranged in channels 118–125 according to the following table:

TABLE

| UTP Wire Pair | Channels |
|---|---|
| 1 (wires 4 & 5) | 121 and 122 |
| 2 (wires 3 & 6) | 120 and 123 |
| 3 (wires 1 & 2) | 118 and 119 |
| 4 (wires 7 & 8) | 124 and 125 |

Figure 4:
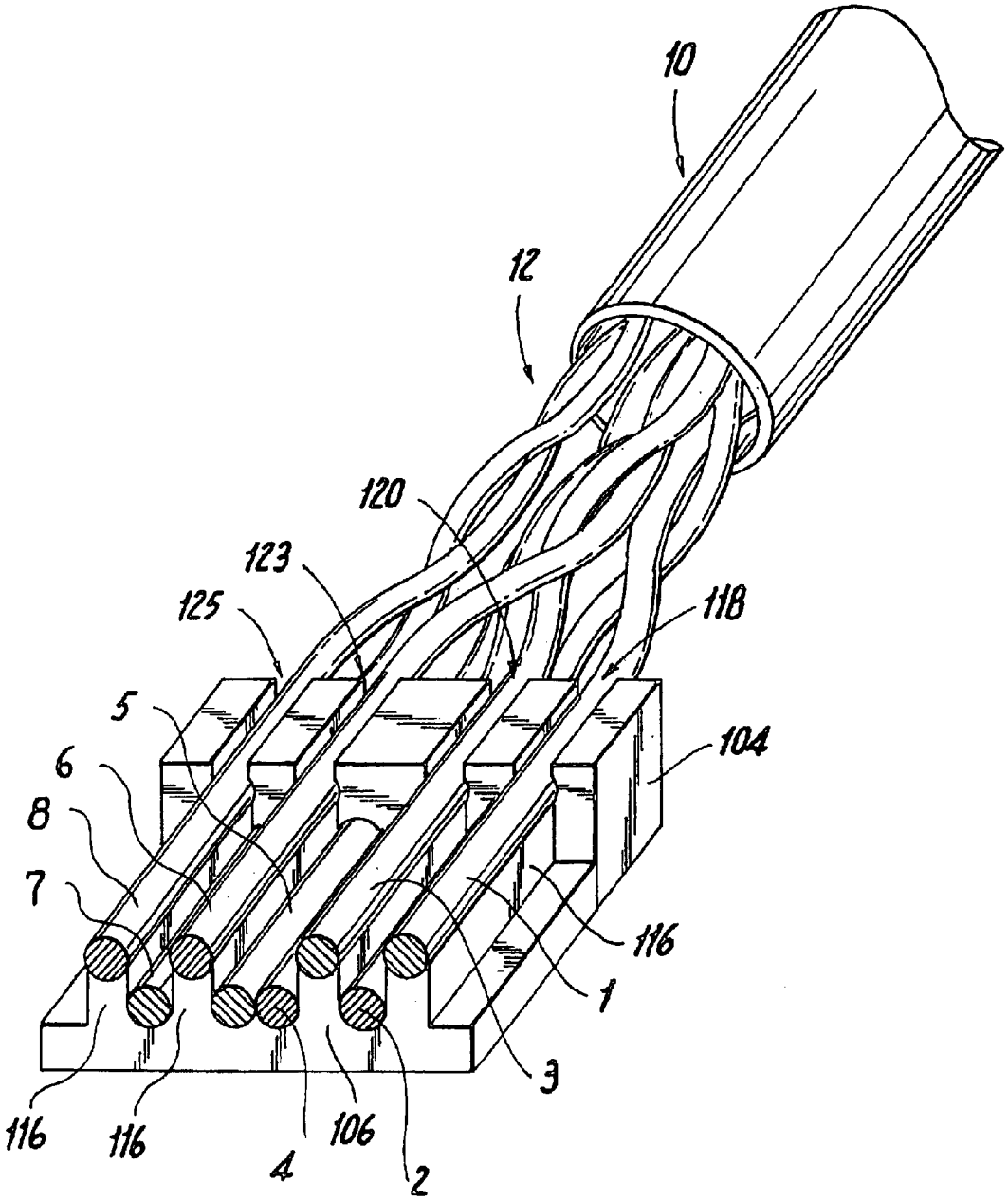
FIG. 4 is a perspective view of the wire guide sled in FIG. 2 with wires inserted and aligned according to a preferred embodiment of the present disclosure.
Figure 5:
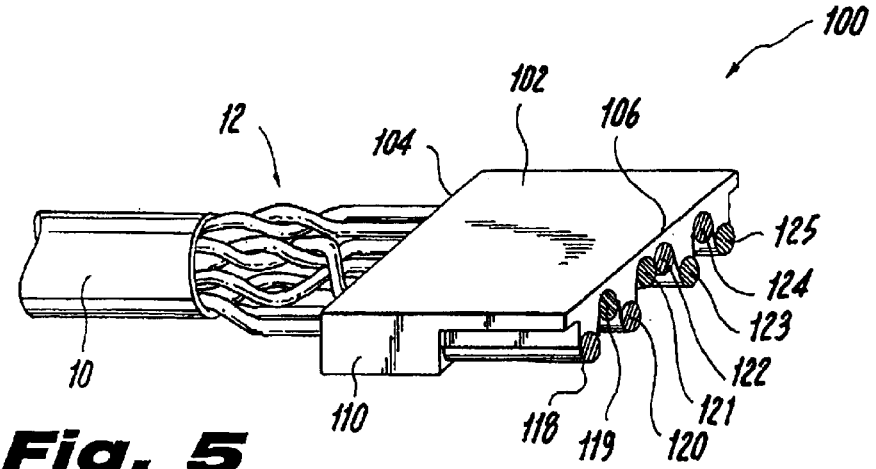
FIG. 5 is another perspective view of the wire guide sled in FIG. 2 with wires inserted and aligned according to a preferred embodiment of the present disclosure.
Figure 6:
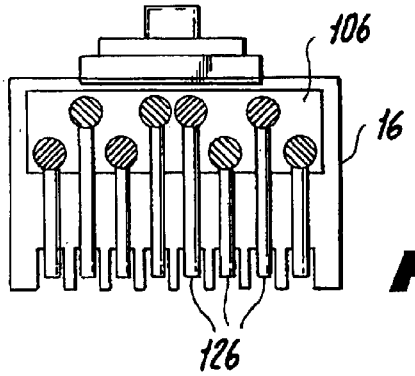
FIG. 6 is a front view of the wire guide sled in FIG. 2 inserted in a communication plug housing.

The formations of wire pairs in guide 100 match with the TIA/BIA T568B style configuration for category 5, 5e and 6 plug communications and advantageously provide crosstalk balance with each adjacent upper or lower channel pair. Preferably, wires carrying positive polarity signal energy are placed adjacent wires carrying negative polarity signal energy, which advantageously improves crosstalk noise reduction. For example, if channel 118 holds a wire with a negative polarity signal, then channel 119, 122, 123 and 125 should hold wires with positive polarity signals and channels 120, 121 and 124 would hold wires with negative polarity signals. The above example is illustrated in FIG. 4.

Alternating the levels of wires 12 in guide sled 100 to match with an alternated plug IDC, advantageously reduces the capacitive and inductive mutual coupling energy, by cross balancing the signals. Cross balancing is the total effect of the source signal polarity vectors that react upon an adjacent victim wire. The source wires positive signals energy and negative signals energy vectors are mutually coupled to the adjacent victim wire pair. According to Fourier's wave theory, coupling the opposite polarity phase signal energy of the source signal to a previously coupled adjacent victim line signal phase energy will completely cancel both energies and therefore removes the noise from the adjacent victim line. The plug coupling capacitance effects of cross balancing the pairs can be calculated by utilizing the low frequency, typically less than 29 MHz, formula $C_{coupling}=1/[R^* \pi^* f^* \text{ SQRT } (1/10^{TSC/20})^2)-1]$. The plug coupling inductance effects of cross balancing the pairs can be calculated by utilizing the low frequency, typically less than 29 MHz, formula $M_{coupling}=R/[\pi^* f^* \text{ SQRT } (1/10^{TSC/20})^2)-1]$. The TOC terminated open circuit and TSC terminated short circuit are laboratory measurements that can be easily applied to RJ45 plugs. Accordingly, it has been determined that using a wire guide sled constructed in accordance with the present disclosure with a communication plug, as compared to a standard single level IDC plug with no wire guide, improves the $C_{coupling}$ and $M_{coupling}$ by estimated 0.4e–12 and 2e–9, respectively. The effective reduction of $C_{coupling}$ and $M_{coupling}$ directly reduces the over all near-end and far-end crosstalk noises.

Figure 7:
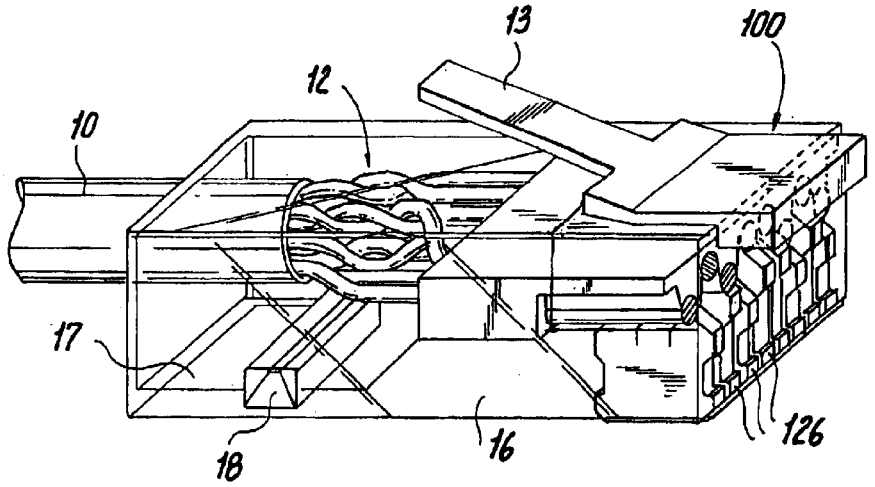
FIG. 7 is a perspective plan view of the wire guide sled in FIG. 2 inserted into a communication plug housing.
Figure 8:
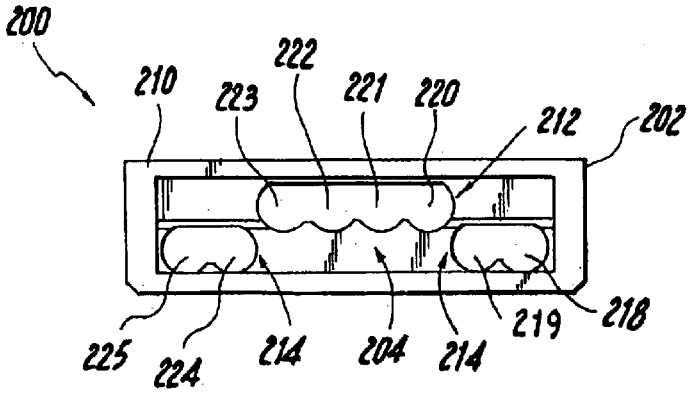
FIG. 8 is a rear view of a second exemplary embodiment of a wire guide sled fabricated in accordance with the present disclosure.
Figure 9:
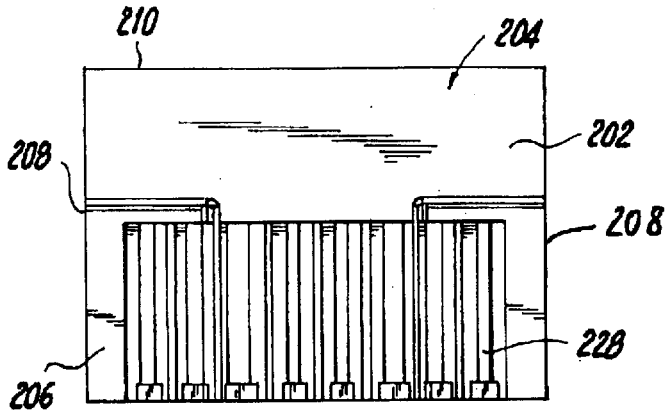
FIG. 9 is a top view of the wire guide sled shown in FIG. 8.
Figure 10:
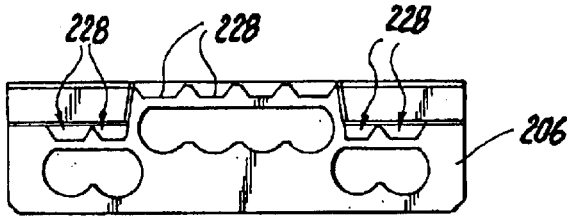
FIG. 10 is a front view of the wire guide sled shown in FIG. 8.
Figure 11:
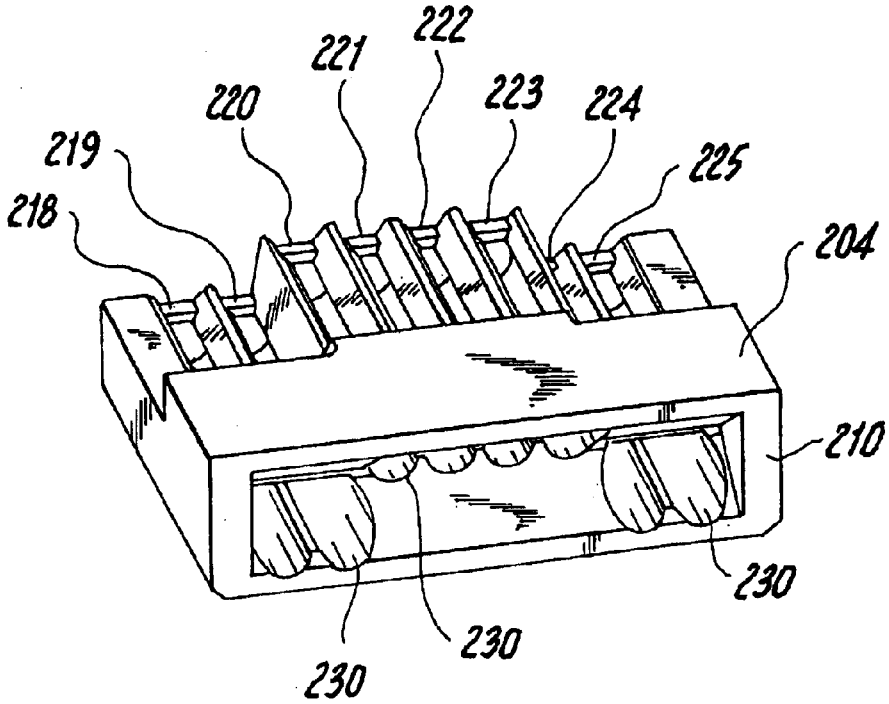
FIG. 11 is a perspective view from the rear end of the wire guide sled shown in FIG. 8.
Figure 12:
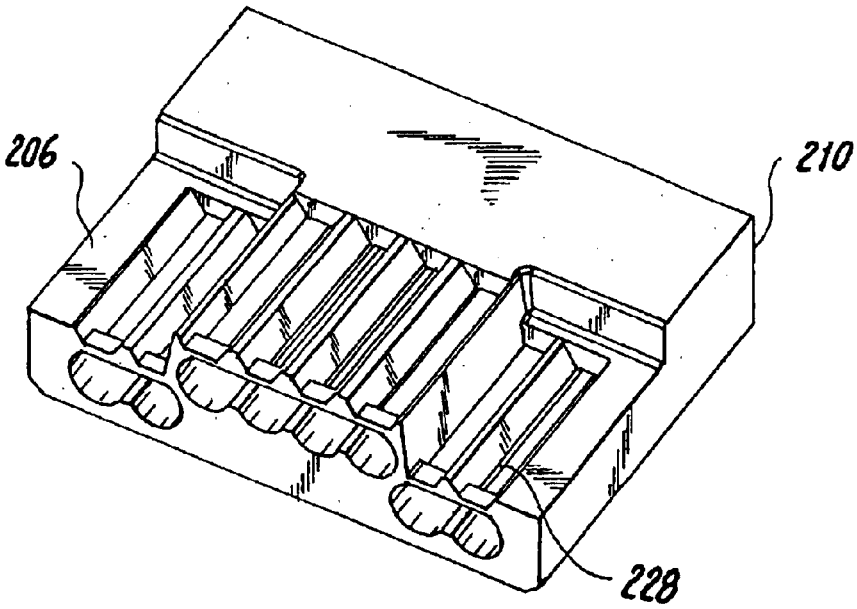
FIG. 12 is a front end perspective view from the front end of the wire guide sled shown in FIG. 8.

Sled 100 is shaped to fit into the receiving port 17 of plug 16. Sled 100 is inserted in the receiving port 17 of plug 16 and wires 12 are held in place while electrical connections are made with the RJ45 IDC contacts 126 prior to the final crimping is completed. FIG. 7 shows the RJ45 plug IDC with top latch 13 up after the wire guide sled 100 is inserted and ready for the final mechanical crimp. After the mechanical crimp of the IDC and/or strain relief, the IDC contacts 126 are electrically connected to the supported wires inside the wire guide sled 100.

FIGS. 8–14 illustrate another preferred embodiment of a wire guide sled 200 constructed in accordance with the present disclosure. Sled 200 comprises a generally rectangular support body 202 having a rear end portion 204, front end portion 206, and longer sides 208. Preferably, body 202 is fabricated of a synthetic resin, or any like material which is resilient or deformable, such as Acrylonitrile/Butadiene/Stryrene (ABS). A wire receiving block 210 is located adjacent rear end portion 204. An upper row 212 and lower row 214 of grooved guide channels extend along the longitudinal axis of body 202, from rear end 204 through receiving block 210 to front end 206. Upper row channels 212 are elevated above lower row channels 214 relative to body 202. In this embodiment, upper row 212 has guide channels 220, 221, 222 and 223 for guiding individual wires. Lower row 214 has guide channels 218, 219, 224 and 225 for guiding individual wires. A slotted cut-out portion 228 is included in each channel adjacent the front end 206. Channels 218–225 include a ramp section 230 adjacent rear end portion 204 for facilitating wire insertion therein. During installation, wires 12 are held in place in wire receiving block 210 and supported in their respective channels 218–225 adjacent front end 206 for IDC crimp connection.

Preferably, the eight wires in UTP cable 10 are inserted in guide channels 218–225, as illustrated in FIG. 13, so that positive and negative signal energy are in adjacent channels of either an upper or lower row 212 or 214, respectively, to increase crosstalk balancing. The formations of the wire pair match with the TIA/EIA T568B style configuration for category 5, 5e and 6 plug communications so that guide sled 200 may be inserted into a standard RJ45 plug 16, as illustrated in FIG. 14.

By stabilizing the wire pairs in the disclosed wire guide sled devices prior to insertion into plug 16 and protecting against the crimping operation that follows, the wire pairs are not distorted or separated. As a result, the de-embedded NEXT and FEXT is controlled without any need for radical redesigning or over-molding of the standard plug. The specific configuration and dimensions may vary depending upon the recess in the plug into which it will be inserted so that it can be utilized with existing plugs without requiring redesign and expensive retooling.

Thus, it can be seen from the foregoing detailed description and attached drawings that the novel wire guide sled of the present disclosure enables secure engagement of the wire pairs therein without distortion or excessive pressure upon the wire pairs to reduce and control crosstalk. The disclosed system facilitates the assembly of the wire pairs of the cable into the plug and transition from the round cross section of the cable into the desired parallel orientation of the alternated lay of the wire pairs in common planes and then the individual wires in the channels for engagement by the plug insulation displacement contacts. The novel assembly requires only the addition of guide sled 100, which maintains cable wire pair alternation in a parallel configuration that provides a low cost and easily mounted design. As noted previously, the specific configuration and dimensions may vary depending upon the recess in the plug into which it will be inserted so that it can be utilized with compatible plugs without requiring redesign and expensive retooling.

Although the disclosed guide sled and associated system have been described with respect to preferred embodiments, it is apparent that modifications and changes can be made thereto without departing from the spirit and scope of the invention as defined by the appended claims.

What is claimed is:

1. A wire sled for aligning a plurality of data transmission elements from a data transmitting media to connect with a media plug having an internal cavity defined by laterally opposed sidewalls and a substantially planar upper surface, the media plug further having electrical contacts to connect to the data transmission elements, a portion of the internal cavity of the plug being defined between the substantially planar upper surface and said contacts, the wire sled comprising:

a support member body having a front portion, a rear portion, and a substantially planar bottom surface that extends from a front end of the front portion to a rear end of the rear portion for contacting the upper surface of the internal cavity, said front portion extending into the portion of said internal cavity defined between the substantially planar upper surface of the plug and the contacts of said plug, the front portion and rear portion further defining at least two rows of elongated channels for receiving and guiding the plurality of data transmission elements into position to connect with the contacts of the media plug, said at least two rows of elongated channels comprising a first row of elongated channels disposed in a first plane and a second row of elongated channels disposed in a second plane that is different than the first plane.

2. A wire sled as recited in claim 1, wherein the body is made of a deformable material.

3. A wire sled as recited in claim 1, wherein the channels have partially enclosed portions.

4. A plug assembly comprising:

a media plug housing; and a wire sled as recited in claim 1 for insertion in a receiving port of the media plug housing.

5. A plug assembly as recited in claim 4, wherein the first row of elongated channels is disposed adjacent the second row of elongated channels.

6. The plug assembly of claim 4 wherein the support member body has opposed side surfaces for contacting the laterally opposed sidewalls of the internal cavity of the media plug.

7. The plug assembly of claim 4 wherein each of the data transmission elements comprises an insulated electrical conductor and each of said contacts of said plug comprises an insulation displacement contact to penetrate the insulation and electrically connect to the electrical conductor of an associated one of the insulated conductors.

8. The plug assembly of claim 4 wherein the first row of elongated channels comprise elongated channels that are substantially parallel to one another and the second row of elongated channels comprise elongated channels that are substantially parallel to one another.

9. The plug assembly of claim 4 wherein each of the elongated channels has an enclosed portion.

10. The plug assembly of claim 4 wherein each of the elongated channels has an enclosed portion defined by the rear portion of the support member body.

11. The plug assembly of claim 4 wherein the front portion of the support member supports the data transmission elements along the connections of said transmission elements with said contacts of said media plug.

12. The plug assembly of claim 4 wherein the front portion of the support member body extends to a front end of the contacts of the media plug.

13. A wire sled for aligning a plurality of data transmission elements from a data transmitting media to connect with a media plug having an internal cavity defined by laterally opposed sidewalls and an upper surface, the media plug further having electrical contacts to connect to the data transmission elements, a portion of the internal cavity of the plug being defined between the upper surface and said contacts, the sled comprising:

a support member body having a front portion and a rear portion, said front portion extending into the portion of said internal cavity defined between the upper surface of the plug and the contacts of said plug, the support member body further defining at least two rows of elongated channels for receiving and guiding the plurality of data transmission elements, said at least two rows of elongated channels comprising a first row of elongated channels disposed in a first plane and a second row of elongated channels disposed in a second plane that is different than the first plane, each of said elongated channels of the first row of elongated channels and each of said elongated channels of the second row of elongated channels having an enclosed portion.

14. A plug assembly comprising:

a media plug housing; and a wire sled as recited in claim 13 for insertion in a receiving port of the media plug housing.

15. The plug assembly of claim 14 wherein each of the data transmission elements comprises an insulated electrical conductor and each of said contacts of said plug comprises an insulation displacement contact to penetrate the insulation and electrically connect to the electrical conductor of an associated one of the insulated conductors.

16. The plug assembly of claim 14 wherein the first row of elongated channels comprise elongated channels that are substantially parallel to one another and the second row of elongated channels comprise elongated channels that are substantially parallel to one another.

17. The plug assembly of claim 14 wherein the front portion and the rear portion each have opposed side surfaces for contacting the laterally opposed sidewalls of the internal cavity.

18. The plug assembly of claim 14 wherein each of the elongated channels has an enclosed portion defined by the rear portion of the support member body.

19. The plug assembly of claim 14 wherein the front portion of the support member supports the data transmission elements along the connections of said transmission elements with said contacts of said media plug.

20. The plug assembly of claim 14 wherein the front portion of the support member body extends to a front end of the contacts of the media plug.

21. A plug assembly for use in association with a cable having a plurality of twisted pairs of insulated wires, the assembly comprising:

a sled defining at least two rows of elongated channels, each of the elongated channels being adapted to receive and guide a respective wire of the twisted pairs of insulated wires, a first row of the elongated channels being disposed generally in a first plane, a second row of the elongated channels being disposed generally in a second plane different than the first plane, wherein the wire received by one of the elongated channels of the first one of the rows is a first wire of a first twisted pair of the twisted pairs of wires, the wire received by one of the elongated channels of a second one of the rows is a second wire of the first twisted pair of the twisted pairs of wires, the wire received by another one of the elongated channels of the first one of the rows is a first wire of a second twisted pair of the twisted pairs of wires, and the wire received by another one of the elongated channels of said first one of the rows is a second wire of said second twisted pair of the twisted pairs of wires.

22. The plug assembly of claim 21 further comprising a plug housing defining a receiving port for receiving the sled.

23. The plug assembly of claim 21 wherein the wire received by one of the elongated channels of a second one of the rows is a first wire of a second twisted pair of the twisted pairs of wires, and the wire received by another one of the elongated channels of said second one of the rows is a second wire of said second twisted pair of the twisted pairs of wires.

24. The plug assembly of claim 23 wherein the wire received by another one of the elongated channels of the second one of the rows is a first wire of a third twisted pair of the twisted pairs of wires, and the wire received by another one of the elongated channels of the second one of the rows is a second wire of the third twisted pair of the twisted pairs of wires.

25. The plug assembly of claim 24 wherein the elongated channel receiving the first wire of the third twisted pair of the twisted pairs of wires and the elongated channel receiving the second wire of the third twisted pair of the twisted pairs of wires are each laterally disposed between the elongated channel receiving the first wire of the second twisted pair of the twisted pairs of wires and the elongated channel receiving the second wire of the second twisted pair of the twisted pairs of wires.

26. The plug assembly of claim 24 wherein the wire received by another one of the elongated channels of the second one of the rows is a first wire of a fourth twisted pair of the twisted pairs of wires, the wire received by another one of the elongated channels of said first one of the rows is a second wire of said fourth twisted pair of the twisted pairs of wires.

27. The plug assembly of claim 26 wherein the elongated channel receiving the first wire of the second twisted pair of the twisted pairs of wires and the elongated channel receiving the second wire of the second twisted pair of the twisted pairs of wires are each disposed between the elongated channel receiving the first wire of the first twisted pair of the twisted pairs of wires and the elongated channel receiving the second wire of the fourth twisted pair of the twisted pairs of wires.

28. The plug assembly of claim 26 wherein the elongated channel receiving the first wire of the third twisted pair of the twisted pairs of wires and the elongated channel receiving the second wire of the third twisted pair of the twisted pairs of wires are each disposed between the elongated channel receiving the second wire of the first twisted pair of the twisted pairs of wires and the elongated channel receiving the first wire of the fourth twisted pair of the twisted pairs of wires.

29. The plug assembly of claim 26 further comprising a plug housing defining a receiving port for receiving the sled.

30. The plug assembly of claim 28 wherein the plug assembly includes a plurality of contacts arranged sequentially and each engageable with a respective one of said wires of the twisted pairs of wires, wherein the first wire of the first twisted pair of the twisted pairs of wires engages a first sequential one of the plurality of contacts, wherein the second wire of the first twisted pair of the twisted pairs of wires engages a second sequential one of the plurality of contacts, the first wire of the second twisted pair of the twisted pairs of wires engages a third sequential one of the plurality of contacts, the second wire of the second twisted pair of the twisted pairs of wires engages a sixth sequential one of the plurality of contacts, the first wire of the third twisted pair of the twisted pairs of wires engages a fourth sequential one of the plurality of contacts, the second wire of the third twisted pair of the twisted pairs of wires engages a fifth sequential one of the plurality of contacts, the first wire of the fourth twisted pair of the twisted pairs of wires engages a seventh sequential one of the plurality of contacts, and the second wire of the fourth twisted pair of the twisted pairs of wires engages a eighth sequential one of the plurality of contacts.

31. The plug assembly of claim 30 further comprising a plug housing defining a receiving port for receiving the sled.

32. The plug assembly of claim 21 wherein each of the elongated channels has an enclosed portion.

33. The plug assembly of claim 21 wherein the upper surface of the internal cavity of the plug is substantially planar, sled comprises a support member body having a front portion and a rear portion each having a bottom surface for contacting the upper surface of the internal cavity, and the front portion extends into the portion of said internal cavity defined between the substantially planar upper surface of the plug and the contacts of said plug.

34. A plug assembly for use in association with a cable having a plurality of twisted pairs of insulated wires, the assembly comprising:

a sled defining at least two rows of elongated channels, each of the elongated channels being adapted to receive and guide a respective wire of the twisted pairs of insulated wires, a first row of the elongated channels being disposed generally in a first plane, a second row of the elongated channels being disposed generally in a second plane different than the first plane, the wires received by the elongated channels of a first one of the rows including a first wire and a second wire of a first twisted pair of the twisted pairs of wires and a first wire and a second wire of a second twisted pair of the twisted pairs of wires, the wires received by the elongated channels of a second one of the rows including a first wire and a second wire of a third twisted pair of the twisted pairs of wires and a first wire and a second wire of a fourth twisted pair of the twisted pairs of wires.

35. The plug assembly of claim 34 further comprising a plug housing defining a receiving port for receiving the sled.

36. The plug assembly of claim 34 wherein the elongated channel receiving the first wire of the fourth twisted pair of the twisted pairs of wires and the elongated channel receiving the second wire of the third twisted pair of the twisted pairs of wires are each disposed between the elongated channel receiving the first wire of the third twisted pair of the twisted pairs of wires and the elongated channel receiving the second wire of the third twisted pair of the twisted pairs of wires.

37. The plug assembly of claim 34 wherein the elongated channel receiving the first wire of the third twisted pair of wires and the elongated channel receiving the second wire of the third twisted pair of wires are each laterally disposed between the elongated channel receiving the second wire of the first twisted pair of the twisted pairs of wires and the elongated channel receiving the first wire of the second twisted pair of the twisted pairs of wires.

38. The plug assembly of claims 34 wherein the elongated channel receiving the first wire of the fourth twisted pair of wires and the elongated channel receiving the second wire of the fourth twisted pair of wires are each laterally disposed between the elongated channel receiving the second wire of the first twisted pair of the twisted pairs of wires and the elongated channel receiving the first wire of the second twisted pair of the twisted pairs of wires.

39. The plug assembly of claim 34 further comprising a plug housing defining a receiving port for receiving the sled.

40. The plug assembly of claim 34 wherein the plug assembly includes a plurality of contacts arranged sequentially and each engageable with a respective one of said wires of the twisted pairs of wires, wherein the first wire of the first twisted pair of the twisted pairs of wires engages a first sequential one of the plurality of contacts, the second wire of the first twisted pair of the twisted pairs of wires engages a second sequential one of the plurality of contacts, the first wire of the second twisted pair of the twisted pairs of wires engages a seventh sequential one of the plurality of contacts, the second wire of the second twisted pair of the twisted pairs of wires engages an eighth sequential one of the plurality of contacts, the first wire of the third twisted pair of the twisted pairs of wires engages a third sequential one of the plurality of contacts, the second wire of the third twisted pair of the twisted pairs of wires engages a sixth sequential one of the plurality of contacts, the first wire of the fourth twisted pair of the twisted pairs of wires engages a fourth sequential one of the plurality of contacts, and the second wire of the fourth twisted pair of the twisted pairs of wires engages a fifth sequential one of the plurality of contacts.

41. The plug assembly of claim 34 wherein each of the elongated channels has an enclosed portion.

42. The plug assembly of claim 34 wherein the upper surface of the internal cavity of the plug is substantially planar, sled comprises a support member body having a front portion and a rear portion each having a bottom surface for contacting the upper surface of the internal cavity, and the front portion extends into the portion of said internal cavity defined between the substantially planar upper surface of the plug and the contacts of said plug.

43. A plug assembly for use in association with a cable having a plurality of twisted pairs of insulated wires, each twisted pair including one wire for carrying a signal that represents a positive polarity signal of the twisted pair and one wire for carrying a signal that represents a negative polarity signal of the twisted pair, the assembly comprising:

a sled defining at least two rows of elongated channels, each of the elongated channels being adapted to receive and guide a respective wire of the twisted pairs of insulated wires, a first row of the elongated channels being disposed generally in a first plane, a second row of the elongated channels being disposed generally in a second plane different than the first plane, the wires received by four of the elongated channels of a first one of the rows including two wires for carrying signals that each represent a respective positive polarity signal and two wires for carrying signals that each represent a respective negative polarity signal, the wires received by four of the elongated channels of a second one of the rows including two wires for carrying signals that each represent a respective positive polarity signal and two wires for carrying signals that each represent a respective negative polarity signal.

44. The plug assembly of claim 43 wherein the wire received by one of the elongated channels of the first one of the rows is a first wire of a first twisted pair of the twisted pairs of wires, the wire received by one of the elongated channels of second one of the rows is a second wire of the first twisted pair of the twisted pairs of wires, the wire received by another one of the elongated channels of the first one of the rows is a first wire of a second twisted pair of the twisted pairs of wires, the wire received by another one of the elongated channels of said first one of the rows is a second wire of said second twisted pair of the twisted pairs of wires.

45. The plug assembly of claim 44 wherein the wire received by one of the elongated channels of a second one of the rows is a first wire of a second twisted pair of the twisted pairs of wires, and the wire received by another one of the elongated channels of said second one of the rows is a second wire of said second twisted pair of the twisted pairs of wires, and wherein the wire received by another one of the elongated channels of the second one of the rows is a first wire of a third twisted pair of the twisted pairs of wires, and the wire received by another one of the elongated channels of the second one of the rows is a second wire of the third twisted pair of the twisted pairs of wires.

46. The plug assembly of claim 45 wherein the elongated channel receiving the first wire of the third twisted pair of the twisted pairs of wires and the elongated channel receiving the second wire of the third twisted pair of the twisted pairs of wires are each laterally disposed between the elongated channel receiving the first wire of the second twisted pair of the twisted pairs of wires and the elongated channel receiving the second wire of the second twisted pair of the twisted pairs of wires, and wherein the wire received by another one of the elongated channels of the second one of the rows is a first wire of a fourth twisted pair of the twisted pairs of wires, the wire received by another one of the elongated channels of said first one of the rows is a second wire of said fourth twisted pair of the twisted pairs of wires.

47. The plug assembly of claim 46 wherein the elongated channel receiving the first wire of the second twisted pair of the twisted pairs of wires and the elongated channel receiving the second wire of the second twisted pair of the twisted pairs of wires are each disposed between the elongated channel receiving the first wire of the first twisted pair of the twisted pairs of wires and the elongated channel receiving the second wire of the fourth twisted pair of the twisted pairs of wires, and wherein the elongated channel receiving the first wire of the third twisted pair of the twisted pairs of wires and the elongated channel receiving the second wire of the third twisted pair of the twisted pairs of wires are each disposed between the elongated channel receiving the second wire of the first twisted pair of the twisted pairs of wires and the elongated channel receiving the first wire of the fourth twisted pair of the twisted pairs of wires.

48. The plug assembly of claim 47 wherein the plug assembly includes a plurality of contacts arranged sequentially and each engageable with a respective one of said wires of the twisted pairs of wires, wherein the first wire of the first twisted pair of the twisted pairs of wires engages a first sequential one of the plurality of contacts, wherein the second wire of the first twisted pair of the twisted pairs of wires engages a second sequential one of the plurality of contacts, the first wire of the second twisted pair of the twisted pairs of wires engages a third sequential one of the plurality of contacts, the second wire of the second twisted pair of the twisted pairs of wires engages a sixth sequential one of the plurality of contacts, the first wire of the third twisted pair of the twisted pairs of wires engages a fourth sequential one of the plurality of contacts, the second wire of the third twisted pair of the twisted pairs of wires engages a fifth sequential one of the plurality of contacts, the first wire of the fourth twisted pair of the twisted pairs of wires engages a seventh sequential one of the plurality of contacts, and the second wire of the fourth twisted pair of the twisted pairs of wires engages a eighth sequential one of the plurality of contacts.

* * * * *